US006942326B2

(12) United States Patent
Hayashi et al.

(10) Patent No.: US 6,942,326 B2
(45) Date of Patent: Sep. 13, 2005

(54) INK TANK

(75) Inventors: Hiroki Hayashi, Kanagawa (JP); Yasuo Kotaki, Kanagawa (JP); Keisuke Matsuo, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/669,456

(22) Filed: Sep. 25, 2003

(65) Prior Publication Data

US 2004/0061751 A1 Apr. 1, 2004

(30) Foreign Application Priority Data

Sep. 30, 2002 (JP) ..... 2002-287551
Jan. 30, 2003 (JP) ..... 2003-021891

(51) Int. Cl.[7] ..... B41J 2/175
(52) U.S. Cl. ..... 347/86
(58) Field of Search ..... 347/84, 85, 86–87, 347/93, 95

(56) References Cited

U.S. PATENT DOCUMENTS 5,453,771 A 9/1995 Waseda et al. ..... 347/86
6,145,972 A * 11/2000 Udagawa et al. ..... 347/86
6,550,898 B2 4/2003 Hayashi et al. ..... 347/85
6,692,115 B2 * 2/2004 Sanada et al. ..... 347/85
6,709,092 B2 3/2004 Hayashi et al. ..... 347/86
2002/0167573 A1 11/2002 Hayashi ..... 347/85
2004/0076447 A1 4/2004 Matsuo et al. ..... 347/85

FOREIGN PATENT DOCUMENTS

EP 0 956 959 A2 * 11/1999 ..... B41J/2/175

* cited by examiner

*Primary Examiner*—K. Feggins
(74) *Attorney, Agent, or Firm*—Fitzpatrick, Cella, Harper & Scinto

(57) ABSTRACT

An ink tank comprises ink holding means capable of impregnating and retaining ink; and a housing for containing the ink holding means, with an ink supply port provided for the housing for supplying to the outside ink impregnated in the ink holding means, and an air inducing port for inducing the air outside into the housing. For this ink tank, the ink holding means further comprises a first ink holding member arranged on the inner face of the housing having the ink supply port open thereto, and a second ink holding member held closely to the first ink holding member, having smaller ink holding power than that of the first ink holding member, and the first ink holding member is essentially formed in the same shape as the shape of the inner face of the housing having the ink supply port open thereto, and substantially covers the inner face entirely, and grooves communicated with the ink supply port on the inner face of the housing having the ink supply port open thereto. With the structure thus arranged, ink can be filled in the second ink holding member almost uniformly on the entire abutting surface on the first ink holding member, thus making it possible to enhance the filling efficiency of ink when ink is filled.

8 Claims, 7 Drawing Sheets

INK TANK

BACKGROUND OF THE INVENTION

1. Field of the Invention

The present invention relates to an ink tank to be mounted on an ink jet recording head for recording on a recording medium by discharging ink droplets. More particularly, the invention relates to the ink tank, which is attachable to and detachable from an ink jet recording head of cartridge type.

2. Related Background Art

For the ink jet recording apparatus that records by discharging ink droplets, there has been known the structure in which an ink jet head and an ink tank are formed separately, and put together when used. The ink tank used for the ink jet recording apparatus of the kind retains ink stably in the usual status (non-recording condition), and needs a mechanism for generating appropriate back pressure (negative pressure) on ink in the recording status in order to supply ink to the ink jet recording head stably.

As one of the methods for generating negative pressure, a porous member, such as urethane form, is used as the member (ink absorbent) that generates negative pressure, and the capillary force of the porous member is utilized. As the negative pressure-generating member, there has been known a structure that uses plural fibrous absorbents as disclosed in the specification of U.S. Pat. No. 5,453,771, besides the urethane form. Particularly when olefinic resin is used as the fibrous absorbent, it can be recycled as material when the used ink tanks are collected. Therefore, from the viewpoint of coping with the environmental problems, it has been positively practiced to adopt the ink tank that utilizes the fibrous absorbent as the negative pressure-generating member.

In recent years, the recording speed of the ink jet recording apparatus has been made faster year after year increasingly. Along with this, it has been required to make the speed of ink supply faster from the ink tank to the ink jet head as a matter of course.

Here, when the fibrous absorbent is used as the negative pressure-generating member in particular, it is roughly observed that fibers are arranged in a desired status of distribution, but in accordance with more precious observation, the status of fibrous distribution here is not uniform due to variation of thickness of each fiber, and the gap between each of them or due to errors occurring in the course of manufacturing process. There are different flow resistances against the movement of retained ink that may take place on the portions where the fibers that form the negative pressure-generating member are concentrated thin or thick. Therefore, it tends to be easier to induce ink from the portion where the concentration thereof is thin and the flow resistance is low. This tendency becomes more conspicuous as the ink flow rate becomes faster. As a result, in order to materialize the higher recording speed, the ink, which is retained on the portion where the fibrous concentration of the fibrous absorbent is smaller, is consumed earlier, and the ink flow path is cut off before the ink, which is retained in the portion having the larger concentration of fibrous distribution, is induced. It is then found that there is a fear that recording may be disabled.

Also, along with the wider use of smaller recording apparatuses, there has been developed a small recording apparatus excellent in portability, and for such a smaller recording apparatus, the main body of the recording apparatus is made smaller, and the ink tank used therefor is made smaller accordingly. For the ink tank used for the smaller recording apparatus of the kind, it is required to enhance the ink storage efficiency and use efficiency so as to make the number of ink tank exchanges smaller. Nevertheless, the ink tank of multiple color integration type, having the ink storage of each color being 10 ml or less in particular, has restriction in terms of the space that should be made available for mounting it on a recording apparatus.

Therefore, for example, in order to enhance the ink storage efficiency by making the height of the ink tank larger, it is required to make the capillary force stronger for retaining ink against the gravitation. This necessitates the fibrous concentration is larger in the ink absorbent, and the resultant space for holding ink is made smaller to that extent. Eventually, therefore, the amount of ink that can be retained is made smaller. Also, if it is intended to arrange the structure so as to retain ink without making the capillary force too larger by making the height of the ink tank smaller for the enhancement of the ink storage efficiency, the ink, which is retained in the ink absorbent immediately above the position of the ink supply port, tends to be induced easier than the ink, which is retained near the bottom face of the ink tank in the position away from the ink supply port in the horizontal direction, because the distance to the ink supply port is shorter. As a result, the difference in facility of ink supply becomes greater at higher recording speed due to difference in distance from the ink supply port, thus inviting the deterioration of ink use efficiency more easily.

Further, for the ink tank having the relatively large dimension in the horizontal direction with the height being suppressed as described above, there is a fear when ink is injected from the ink supply port 114 that the injected ink in the process of manufacture may cover the upper face in the position immediately above the ink supply port 114, because the injected ink reaches the upper face of the ink absorbent 161 before ink is injected into the ink absorbent 161 in the position away from the ink supply port 114. If the condition becomes such as this, the air remaining in the ink absorbent 161 cannot be replaced with the air any longer to make it difficult to impregnate ink in the position where the air still remains and ink is yet to be impregnated, thus deteriorating the filling efficiency of ink eventually.

SUMMARY OF THE INVENTION

Therefore, to cope with such situations, the present invention is designed. It is an object of the invention to provide an ink tank for which ink can be injected sufficiently and stably without deteriorating the filling efficiency of ink even if the ink tank is made small and flat having wide width and low height.

Also, it is another object of the invention to provide a small and flat ink tank having wide width and low height, which is capable of carrying out the stable ink supply at high speed corresponding to high-speed recording.

In order to achieve the aforesaid object, the ink tank of the present invention comprises ink holding means capable of impregnating and retaining ink; and a housing for containing said ink holding means, said housing being provided with an ink supply for supplying ink impregnated in said ink holding means to the outside, and an air inducing port for inducing an atmospheric air into said housing, wherein said ink holding means comprises a first ink holding member arranged on the inner face of said housing where said ink supply port is open, and a second ink holding member held closely to said first ink holding member, having smaller ink holding power than that of said first ink holding member, said first ink holding member is substantially the same shape as the shape of the inner face of said housing where said ink supply port is open, and substantially covers the said inner face entirely, and grooves communicated with said ink supply port on the inner face of said housing where said ink supply port is open.

In accordance with the present invention, on the inner face of the ink tank housing where the ink supply port is open, a first ink holding member is arranged following essentially the shape of this inner face, and also, on this inner face, grooves are arranged and communicated with the ink supply port. In this way, when ink is filled in the ink tank, it is made possible to fill ink in a second ink holding member, which is arranged on the first ink holding member, having smaller ink holding power than that of the first ink holding member, for the first time after ink has been filled entirely in the first ink holding member manner. Then, in this way, when ink is filled, ink can be filled in the second ink holding member almost uniformly on the entire abutting surface on the first ink holding member, thus making it possible to enhance the filling efficiency of ink.

Also, in order to achieve another object, the ink tank of the present invention comprises a housing for containing ink holding means capable of impregnating and retaining ink; an ink supply port provided for the housing for supplying to the outside ink in the ink holding means, and an atmosphere communication port provided for the housing for inducing the air outside into the housing, and said ink tank being made attachable to and detachable form an external member for executing the supply of ink to the external member in the status of the ink holding means being in contact with the external member. For this ink tank, the ink holding means comprises a sheet type first ink holding member capable of being in contact with the external member, and a second ink holding member held closely with the first ink holding member for supplying liquid to the first ink holding member, and the ink holding power of the first ink holding member is larger than that of the second ink holding member, and the first ink holding member is essentially held in the form following the shape of inner face of the housing on the portion having the ink supply port provided.

As more preferable structure, at least one of the first ink holding and the second ink holding member should be formed with fibrous body. Particularly, it is preferable to form the first ink holding member with fibrous body, and to arrange the main axial direction of the majority of the fibrous body forming the fibrous body to be essentially perpendicular to the abutting direction on an external member. Further, it is preferable to arrange the laminated direction of the laminated body to be essentially in the same direction as the abutting direction on the external member. It is preferable to arrange the main axial direction of the majority of fibers forming the laminated fibrous body to follow essentially the longitudinal direction of the face of the housing essentially perpendicular to the abutting direction on the external member, having the ink supply port provided therefor.

The ink tank of the present invention in another mode is such that the ink holding power of the first ink holding member is larger than that of the second ink holding member. Therefore, ink in the ink tank is easily retained on the circumference of the external member, which serves as the part to which ink is led out (ink is supplied), and produces the effect that ink in the ink tank is stabilized efficiently. In addition, the first ink holding member is configured to essentially follow the inner shape of the portion of the housing having the ink supply port provided therefor, hence making it possible to carry out the liquid supply stably even when ink is supplied in a large flow rate without being affected by the fluctuation of liquid flow that moves in the second ink holding member when ink is supplied, that is, without being affected easily by the variation of flow resistance (varied concentrations of fibers or the like) in the second ink holding member.

Particularly, in a thin and flat ink tank, it is difficult to lead out liquid retained in a position near the bottom face of the container and away from the ink supply port in the horizontal direction, and there is a high possibility that liquid retained in other portions is consumed earlier eventually. However, in accordance with the structure of the present invention, it is possible to supply ink stably in such a shape of an ink tank as this.

Further, the first ink holding member is substantially the same shape as the inner face of the housing. Therefore, it is made possible to utilize the inner space of the housing effectively without making the shape of the housing, particular the inner shape thereof, complicated.

With the ink holding power of the first ink holding member being larger than that of the second ink holding member, the first ink holding member has relatively more liquid remainders than the second ink holding member after liquid is lead out. As a result, the influence that may be exerted here becomes greater particularly when liquid is supplied at high speed. Therefore, the first ink holding member is arranged to be of thin sheet type to enable the ink remainders to be reduced by making the content volume of the first ink holding member smaller, while demonstrating the aforesaid effect of the present invention.

BRIEF DESCRIPTION OF THE DRAWINGS

FIGS. 5A, 5D, 5E, and 5F are vertically sectional views of the ink tank; and FIGS. 5B and 5C are cross sectional views of the bottom portion thereof.

FIG. 6A is the perspective view; FIG. 6B is the plan view that shows the inner face of the bottom portion thereof; and FIG. 6C is the cross-sectional view.

DETAILED DESCRIPTION OF THE PREFERRED EMBODIMENTS

Hereinafter, with reference to the accompanying drawings, the detailed description will be made of the embodiments in accordance with the present invention.

Figure 1:
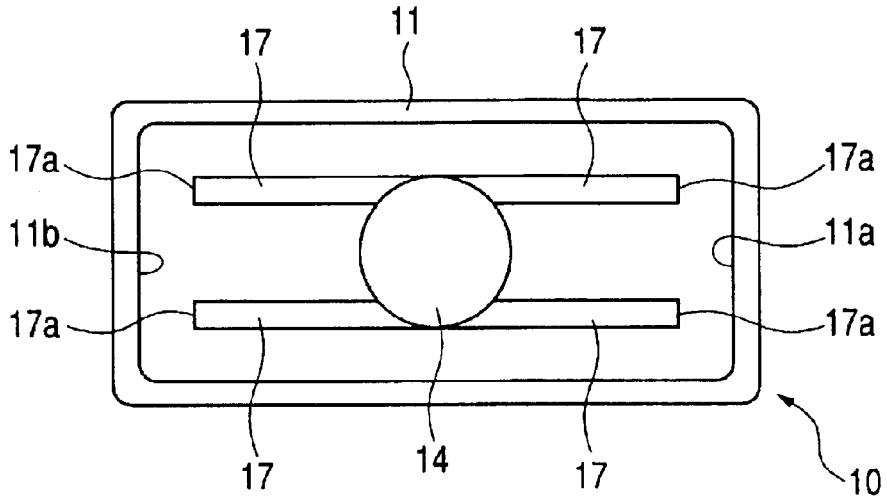
FIG. 1 is a plan view that shows the inner face of the bottom end of the container of an ink tank embodying the present invention.
Figure 2:
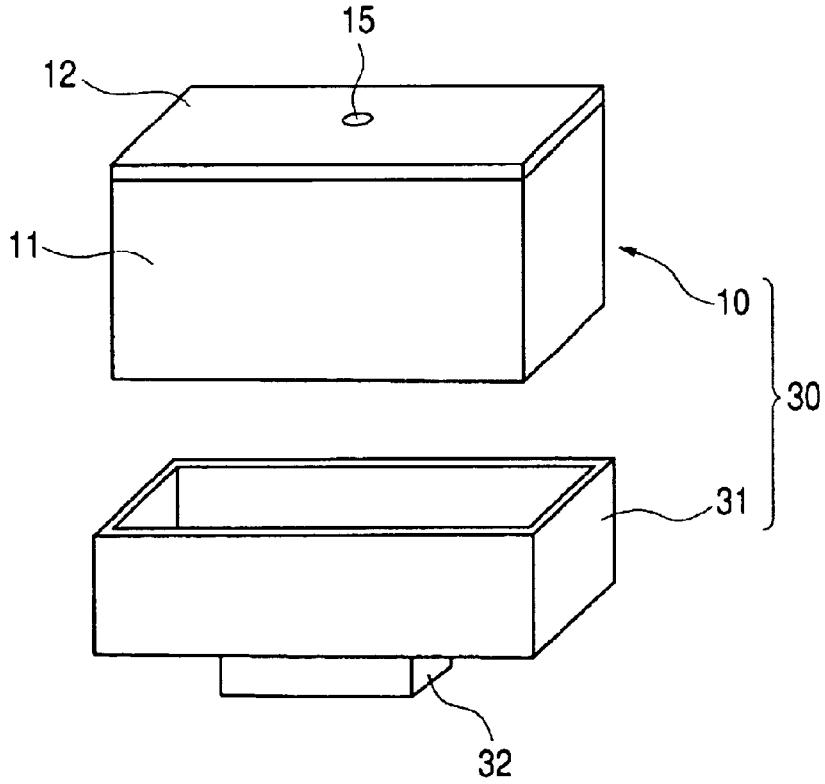
FIG. 2 a perspective view that shows the ink tank represented in FIG. 1, and the ink jet cartridge having a holder formed integrally with an ink jet head, which holds the ink tank detachably.
Figure 3:
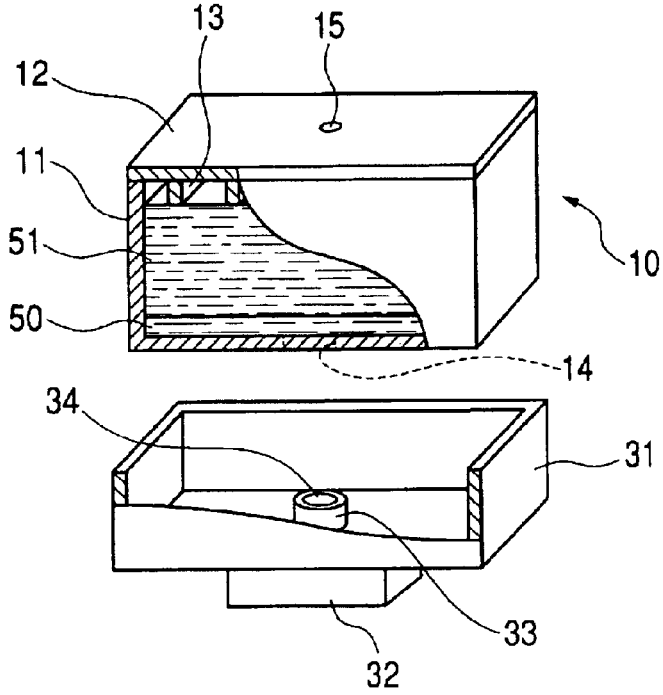
FIG. 3 is a partially broken perspective view that shows the ink jet cartridge represented in FIG. 2.
Figure 4:
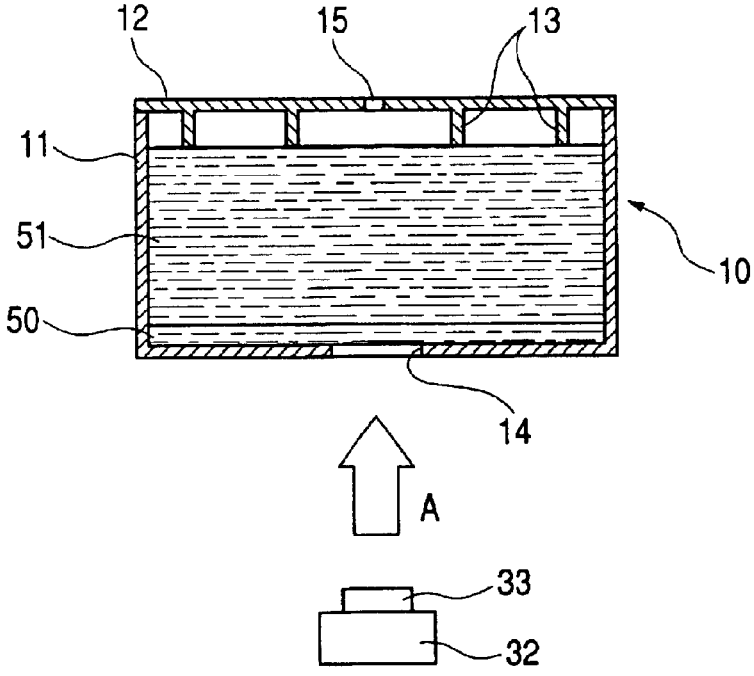
FIG. 4 is a cross-sectional view that shows the ink jet cartridge represented in FIG. 2.

FIGS. 1 to 4 are views that schematically illustrate the ink tank 10 embodying the present invention. FIG. 1 is a schematic view that shows the structure of the inner face of the bottom portion of the ink tank 10 of the present embodiment, which is equivalent to a plan view observed from the opening portion side to be closed by joining the container 11, which will be described later, and a covering member 12. The ink tank 10 of the present embodiment constitutes an ink jet head cartridge 30 together with a holder 31. FIG. 2 is a perspective view that shows this ink jet cartridge. FIG. 3 is a partially broken perspective view. FIG. 4 is a cross-sectional view. In this respect, FIGS. 2 to 4 are views that illustrate the holder 31 and the ink tank 10 in the state where these are separated, and in FIG. 4, the holder 31 is represented only in the configuration of portions of the ink jet head 32.

In the ink jet cartridge 30 shown in FIGS. 2 to 4, the holder 31 is provided integrally with the ink jet head 32, which discharges ink. For the ink tank 10, a first ink holding member 50 and a second in holding member 51 are laminated and filled in the housing, which is formed by the container 11 and the covering member 12. The ink, which is supplied to the ink jet head 32, is impregnated and retained in them in the container. The ink tank is attachable to and detachable from the holder 31.

The ink jet head 32 is provided in a position, which is on the bottom portion of the holder 31 when used, and provided with discharge port group (not shown) that discharge ink. For the connecting portion between the holder 31 and the ink tank 10, an ink receiving tube 33 is extruded, and the ink receiving tube 33 is communicated with the discharge port group of the ink jet head 32 through an ink supply path (not shown). For the tip of the ink receiving tube 33, there is arranged a filter 34 in order to prevent foreign substances from entering the ink receiving tube 33.

The ink tank 10 is provided with the box-like container 11, the upper portion of which is open, and the covering member 12, which cover the upper portion of the container 11. In this housing, the ink-containing chamber is formed. In accordance with the present embodiment, the ink tank 10 is 40 mm long, 16 mm wide, and 18 mm high.

For the covering member 12, an atmosphere communication port 15 is formed to induce the air outside into the ink tank 10. Also, for the inner face of the covering member 12, an extruded rib structure 13 is formed. The second holding member 51 filled in the ink tank 10 abuts against the tip of the rib structure 13. In this way, a buffering space is secured between the atmosphere communication port 15 and the second ink holding member 51.

For the bottom face of the container 11, the ink supply port 14 is arranged to serve as an opening for supply ink to the ink jet head 32 side. On the circumference of the ink receiving tube 33, an O-ring (not shown) is attached in order to prevent the ink, which is supplied from the ink tank 10 through the ink receiving tube 33, from leaking into the holder 31, while preventing the ink evaporation. Also, as shown in FIG. 1, for the inner face of the bottom portion of the container 11, there are formed four grooves 17, which extend from the ink supply port 14 located near the center thereof toward the wall faces 11*a* and 11*b* facing each other in the longitudinal direction of the container 11. Each groove 17 does not extend up to the adjacent wall faces 11*a* and 11*b*, and predetermined gaps are provided between the tip 17*a* of each groove 17, and the wall faces 11*a* and 11*b*. In accordance with the present embodiment, the diameter of the ink supply port 14 is 9 mm; the width of each groove 17 is 1 mm; the depth is 0.2 mm, and the distance between the tips 17*a* of the each groove 17 and the adjacent wall faces 11*a* and 11*b* is 2 mm, respectively.

As shown schematically in FIG. 3 and FIG. 4, the ink supply port 14 of the ink tank 10 and the ink receiving tube 33 of the holder 31 are formed in positions facing each other when the ink tank 10 is mounted on the holder 31. Then, the ink receiving tube 33 is inserted into the ink supply port 14, and abuts against the first ink holding member 50. In this way, when the ink tank 10 is mounted on the holder 31, ink in the ink tank 10 is supplied to the discharge port group of the ink jet head 32 through the ink receiving tube 33 of the holder 31 and the ink supply path. At this juncture, the air corresponding to the supply amount of ink is induced into the ink tank 10 through the atmosphere communication port 15.

The first ink holding member 50 and the second ink holding member 51 are mounted in the ink tank 10 so that the first ink holder member 50 is positioned between the second ink holding member 51 and the bottom face of the ink tank 10. Then, the first holding member 50 is mounted so as to be closely in contact with the second ink holding member 51, and cover the ink supply port 14 from the inner side. The first ink holder member 50 is configured to essentially follow the inner shape of the portion (bottom face) of the container 11 where the ink supply port 14 is provided. Both first ink holding member 50 and second ink holding member 51 are arranged to impregnate and retain ink. However, the holding power (capillary force) of the first ink holding member 50 is defined to be larger than the ink holding power of the second ink holding member 51. In this manner, the ink, which is retained in the second ink holding member 51, is efficiently induced into the first ink holding member 50 so as to enhance the efficiency of consumption of ink retained in the second ink holding member 51.

In accordance with the present embodiment, the ink-holding members 50 and 51 are the aggregate of fibers compressed in the laminating direction after the webs, each having fibers of polyolefin thermo-plastic resin arranged substantially in one direction, are laminated. Then, the first ink holding member 50 is formed by fiber, the fineness of which is 6.7 dtex (diameter: approximately 54 $\mu$m), and the density thereof after compression is approximately 0.08 g/cm$^3$. The second ink holding member 51 is formed by fiber, the fineness of which is 2.2 dtex (diameter: approximately 18 $\mu$m), and the density thereof after compression is approximately 0.20 g/cm$^3$.

As schematically shown in FIG. 4, the first ink holding member 50 and the second ink holding member 51 are arranged in the container 11 so that the fiber direction, that is, the longitudinal direction (the main axial direction) of the major portion of fibers that form the fibrous bodies thereof is all vertical essentially to the abutting direction A of the ink receiving tube 33, and that the direction of web lamination of the fibrous bodies is essentially horizontal to the abutting direction A of the ink receiving tube 33.

The first ink holding member 50 is of thin sheet type, and provided with substantially the same plane configuration as the inner face of the bottom portion of the container 11 where the ink supply port 14 is arranged. Therefore, the first ink holding member 50 is arranged for the bottom portion of the ink tank 10 with almost no gaps, thus making it possible to utilize effectively and efficiently the space in the ink tank 10 for containing ink. In accordance with the present embodiment, the flat shape of the first ink holding member 50, which is essentially perpendicular to the abutting direction A of the ink receiving tube 33, is made a rectangular of 14 mm×38 mm, and the thickness of the ink receiving tube 33 in the abutting direction A is made 1.5 mm.

Also, the second ink holding member 51 has likewise essentially the same flat configuration as that of the inner face of the bottom portion of the container 11 where the ink supply port 14 is arranged. In accordance with the present embodiment, the flat shape of the second ink holding member 51, which is perpendicular to the abutting direction A of the ink receiving tube 33, is made a rectangular of 14 mm×38 mm, and the thickness thereof is made 12.5 mm.

With the structure thus arranged, the ink, which is impregnated and held in the second in holding member 51, is supplied to the ink receiving tube 33 through the first ink holding member 50. Then, as described earlier, the ink holding power (capillary force) of the first ink holding member 50 is made greater than that of the second ink holding member 51, and the difference in the ink holding powers of the first ink holding member 50 and the second ink holding member 51 becomes far greater than the difference in the ink holding powers that may be generated due to the variations of the inner structures of the ink holding members 50 and 51. As a result, irrespective of the presence of the inner structural variations, the ink, which corresponds to the amount of ink consumption, flows exactly and rapidly from the second ink holding member 51 side having the smaller ink holding power to the first ink holding member 50 when ink is consumed.

Furthermore, the upper face and the lower face of the first ink holding member 50 and second ink holding member 51 are in contact with each other almost entirely so as to enable such entire face to act on inducing ink from the second ink holding member 51 side to the first ink holding member 50 side. Therefore, with the structure thus arranged, it becomes possible to block the lowering of the ink liquid level at the interface between the first ink holding member 50 and the second ink holding member 51. In other words, the ink, which is in the second ink holding member 51 including ink existing on the position away from the ink supply port 14, is almost exhausted. Consequently, after there exists no longer any ink flowing from the second ink holding member 51 to the first ink holding member 50, and then, after ink is consumed more, there occurs the portion in the first ink holding member 50 where no ink exists for the first time. With the structure thus arranged, it becomes possible to induce almost the entire ink retained in the second ink holding member 51 into the first ink holding member 50 side irrespective of the difference in flow resistances due to the difference in the lengths of ink flow paths or due to the variation of inner structure, thus enhancing the use efficiency of ink retained in the second ink holding member 51.

Also, in the status that the ink tank 10 is mounted on the holder 31, the circumference of the portion of the first ink holding member 50 upon which the ink receiving tube 33 abuts is partially compressed by the ink receiving tube 33 that abuts against it. Therefore, in this status, the ink holding power of the first ink holding member 50 becomes larger than that in the other portions on circumference of the portion having the ink receiving tube 33 to abut against it. In this way, it becomes possible to obtain not only the effect of collecting ink around the ink receiving tube 33, but also, to supply ink more efficiently. Also, since the first ink holding member 50 is of thin sheet type, the influence that may be exerted by difference in flow resistances does not act greatly in the first ink holding member 50. As a result, in accordance with the structure of the present embodiment, the use efficiency of ink can be enhanced extremely high in terms of the ink tank 10 as a whole.

Here, with reference to FIG. 4 and FIGS. 8A and 8B, which are cross-sectional views of the ink tank, the connecting condition of the ink tank 10, and the ink jet head 32 and the holder 31 will be described further in detail. In this respect, in order to facilitate observation, the holder 31 is omitted in the representations of FIG. 4 and FIGS. 8A and 8B.

Figure 8A:
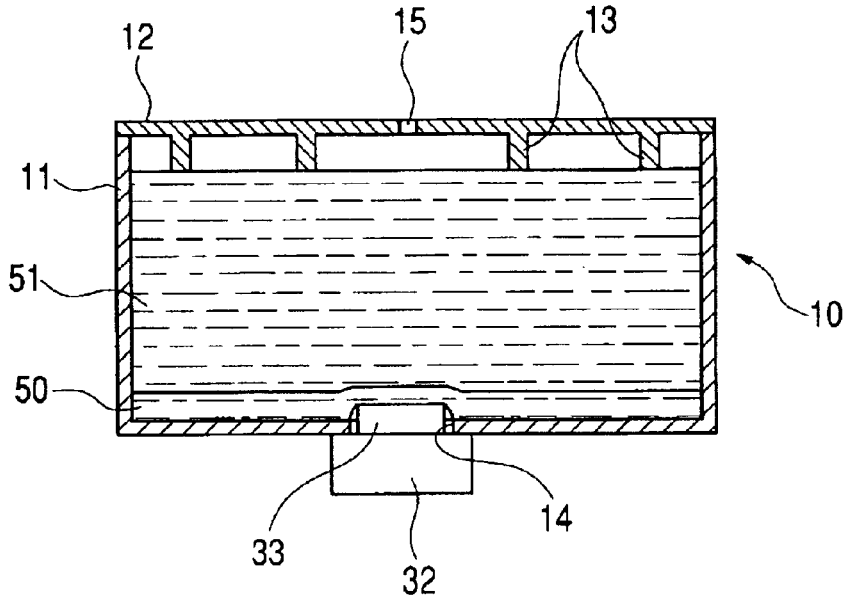
FIG. 8A is a cross-sectional view that shows the status of conjugation between the ink tank and ink jet head in accordance with the present invention.
Figure 8B:
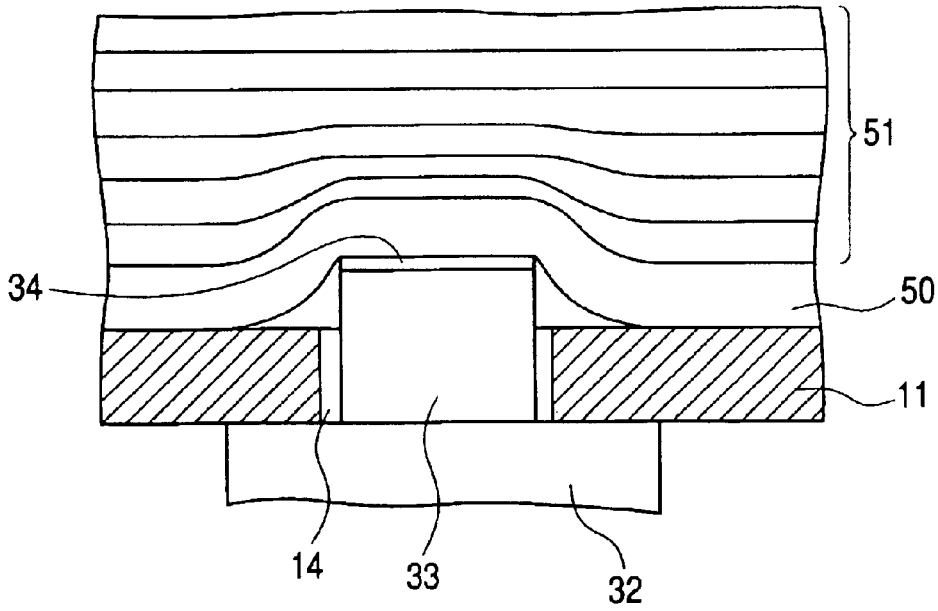
FIG. 8B is an enlarge view the principal part thereof.

When the ink jet head 32 and the ink tank 10 are connected (that is, the ink tank 10 is mounted on the holder 31) as shown in FIGS. 8A and 8B from the status where the ink jet head 32 (holder 31) and the ink tank 10 are not connected as shown in FIG. 4, the ink receiving tube 33 abuts against the first ink holder member 50 in the ink supply port 14, and the ink, which is retained in the first ink holder member 50, is supplied to the discharge port group of the ink jet head 32 through the ink receiving tube 33 and the ink supply path.

In the status shown in FIGS. 8A and 8B, the ink receiving tube 33 advances into the ink supply port 14, and then, the ink receiving tube 33 is pushed into the first ink holding member 50 (approximately by 0.5 mm in accordance with the present embodiment). Thus, the first ink holding member 50 is given the force to push it into the second ink holding member 51. The first ink holding member 50 and the second ink holding member 51 are then contracted in the abutting direction A as shown in FIG. 4 accordingly.

FIG. 8B shows this abutting condition in enlargement. The advancement of the ink receiving tube 33 into the ink supply port 14 is absorbed the deformations of both ink holding members 50 and 51. At first, the sheet-type first ink holding member 50 is deformed moderately corresponding to the advancement of the ink receiving tube 33, and then, the second ink holding member 51 is deformed corresponding to the deformation of the first ink holding member 50. As readily understandable from the representation of FIG. 8B, the second ink holding member 51 is deformed by way of the first ink holding member 50 in such a manner that the compressibility is made maximum in the central portion where the ink receiving tube 33 abuts against the first ink holding member 50, and it is made moderately toward the circumference thereof. Particularly, in accordance with the present embodiment, the laminating direction of the fibrous bodies of the first ink holding member 50 and the second ink holding member 51 is essentially in parallel with the abutting direction A of the ink receiving tube 33, hence making it easier for them to be displaced in the abutting direction A. As a result, the compressibility around the ink supply port 14 can be enhanced without any immoderate force. Then, the first ink holding member 50 has a greater ink holding power when compressed as compared with the usual condition (shown in FIG. 4) where the ink receiving tube 33 does not abut against it, thus making it possible to retain ink more stably. Also, with the smoother deformation of the ink holding members 50 and 51 by the abutting of the ink receiving tube 33, it becomes possible to make the space in the ink tank 10 extremely small where the ink holding member 50 and 51 are not present.

Next, in conjunction with FIGS. 9A to 9E, the detailed description will be made of the movement of ink in the ink tank 10 when ink is supplied.

FIGS. 9A to 9E are cross-sectional views that illustrate the ink tank 10 in the state of being connected with the ink jet head 32, and schematically illustrate the ink movement in the ink tank 10. FIG. 9A to FIG. 9E schematically represent each condition in which ink (indicated by cross stripes) is being consumed sequentially.

Figure 9A:
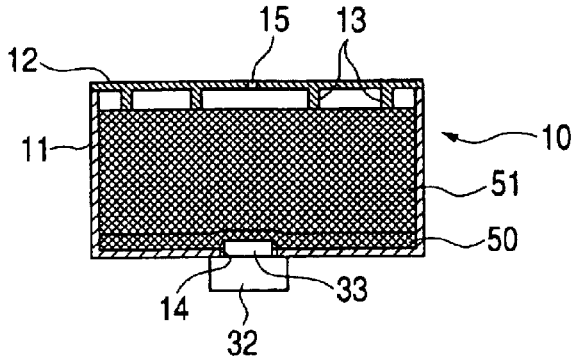
FIGS. 9A, 9B, 9C, 9D, and 9E are cross-sectional views that illustrate sequentially each status of ink being consumed in the ink tank of the present invention.
Figure 9B:
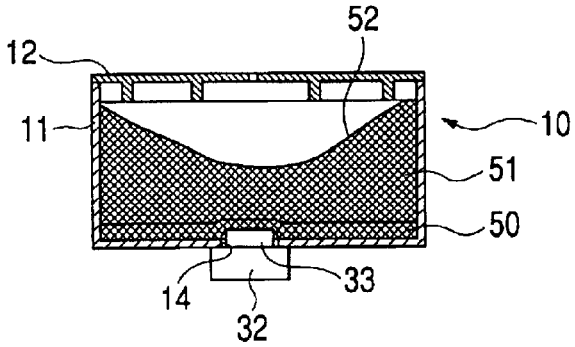
Figure 9C:
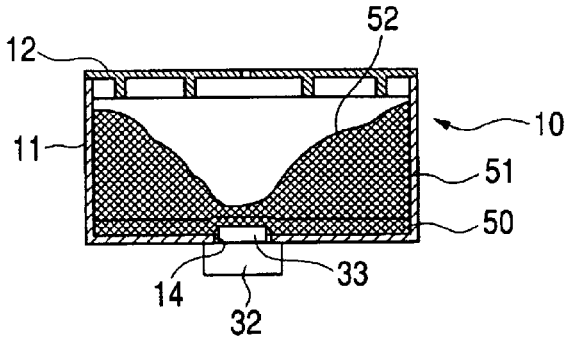
Figure 9D:
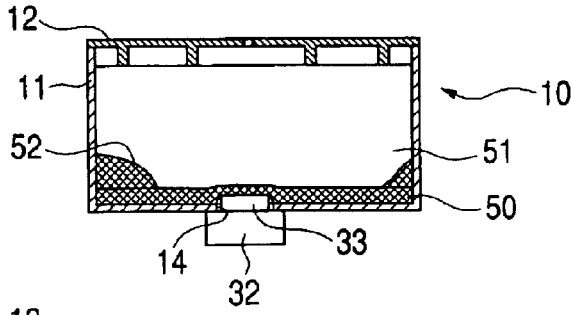
Figure 9E:
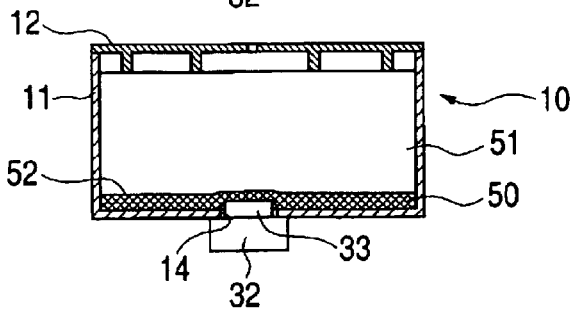

FIG. 9A shows the initial condition before ink beings to be consumed. Ink is filled sufficiently in the ink holding members 50 and 51. When ink is supplied from this condition to the ink jet head 32 through the ink supply port 14 as shown in FIG. 9B, ink 52 in the second ink holding member 51 is consumed in continuation with the consumption of ink in the first ink holding member 50, and then, the ink liquid level 52 is lowered. In the condition shown in FIG. 9C, ink is consumed along the recording operation of the ink jet head 32 and the like. In the position immediately above the ink supply port 14 where it is easiest to lead out ink, the ink liquid level 52 is caused to reach around the first ink holding member 50. However, ink in other positions still remains sufficiently, and the ink liquid level 52 is still in the second ink holding member 51. Then, in the condition shown in FIG. 9D, ink is further consumed so as to cause ink in the second ink holding member 51 to move sequentially into the first ink holding member 50. Therefore, while the first ink holding member is in a condition to have ink filled in it almost fully, the ink in the second ink holding member 52 has been almost consumed. In other words, ink moves from the second ink holding member 51 at any time so as to be filled in the portion where ink in the first ink holding member 50 has been consumed. Therefore, the first ink holding member 50 is maintained in condition where ink is almost filled. Then, as shown in FIG. 9E, there is almost no ink in the second ink holding member 51, and only ink in the first ink holding member 50 is retained substantially, and then, when ink is further supplied to the ink jet head 32, ink in the first ink holding member 50 is consumed, thus having completely used ink in the ink tank 10.

The mechanism of this ink consumption will be further described. The ink, which is impregnated and retained in the second ink holding member 51 is supplied to the ink receiving tube 33 through the first ink holding member 50. As described earlier, the first ink holding member 50 has a lower ink holding power (capillary force) than that of the second ink holding member 51. It has the resultant effect of collecting ink around the ink receiving tube 33. In this respect, the circumference of the portion of the first ink holding member 50 where it is in contact with the ink receiving tube 33 under pressure is compressed, thus having a larger ink holding power.

Difference in the ink holding powers between the ink holding members 50 and 51 is far greater than the difference in the ink holding powers to be generated due to the variations of the inner structure of the ink holding members. As a result, it becomes possible to neglect the variations of the inner structures. Thus, it is made possible to enable ink to flow immediately from the second ink holding member 51 having smaller ink holding power into the portion of the first ink holding member 50 where ink has been consumed, and then, it becomes possible to block the ink liquid level 52 to be lowered on the interface between the ink holding members 50 and 51. In other words, after almost no ink remains in the second ink holding member 51 including the positions away from the ink supply port 14, and when ink is further consumed, there is no ink that may flow from the second ink holding member 51 to the first ink holding member 50. Then, for the first time, there occurs the portion where ink does not exist in the first ink holding member 50. Here, the fibrous concentrations of the ink holding members 50 and 51 are defined so as to make the difference in the capillary forces of the ink holding members 50 and 51 larger to the extent that the difference in flow resistances due to the length of ink flow path or the variations of the inner structure can be neglected. In this way, it is made possible to enhance the use efficiency of ink in the ink tank 10.

Next, with reference to FIGS. 5A to 5F, the detailed description will be made of the process to inject ink into the ink tank 10 at the time of manufacture. FIGS. 5A to 5F are views that illustrate each of the processes in which ink is filled in the ink tank 10. In order to make each condition easily understandable when ink is filled in each process, FIGS. 5A, 5D, 5E, and 5F are arranged to be vertically sectional views, and FIGS. 5B and 5C represent the ink tank 10 in a mode of horizontally sectional view of the bottom portion thereof. Then, the ink-filled area 20 is indicated schematically.

In accordance with the present embodiment, the ink injection is carried out by the so-called decompressed injection method in which ink is injected into the ink tank 10 after the inside thereof is decompressed. Therefore, when ink is injected, a decompression valve (not shown) closes the atmosphere communication port 15, and an ink supply line (not shown), which is provided with an injection valve, is connected with the ink supply port 14.

Figure 5A:
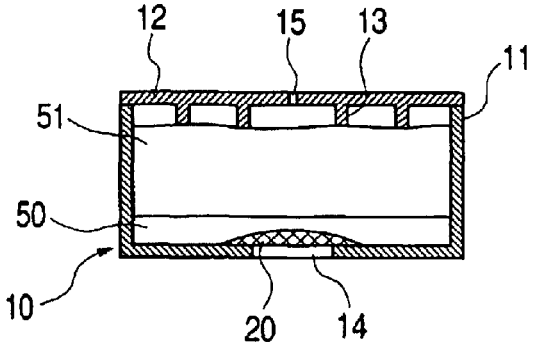
FIGS. 5A, 5B, 5C, 5D, 5E, and 5F are views that illustrate the status of ink injection in each of the processes for injecting ink into the ink tank shown in FIG. 1.
Figure 5B:
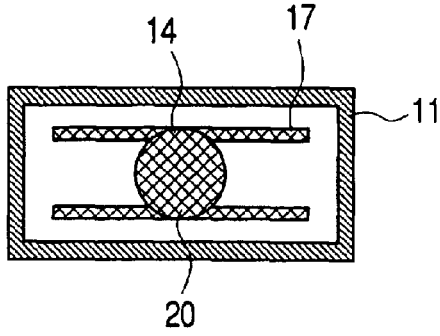
Figure 5C:
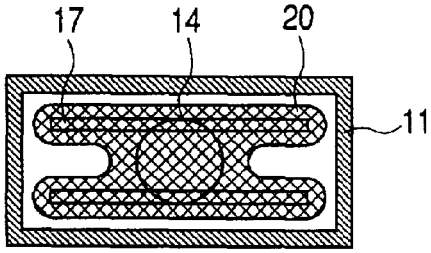

FIGS. 5A and 5B are views that illustrate the initial condition where the injection valve is open to begin injecting ink. As shown in FIG. 5A, ink is at first absorbed by the first ink holding member 50 on the circumference of the ink injection port 14. At this juncture, whereas the first ink holding member 50 has a specific concentration and presents a specific resistance, there is almost no flow-in resistance in the groove 17. Consequently, as shown in FIG. 5B, ink is filled in the groove 17 almost simultaneously.

Next, as shown in FIG. 5C, the ink-filled area 20 expands to the first ink holding member 50 in the circumference of the ink supply port 14 and the groove 17. With the groove 17 thus arranged, the ink filling to the first ink holding member 50 is carried out in parallel almost on the entire surface of the bottom potion of the ink tank 10. As a result, it becomes possible to fill ink efficiently into the portion away from the ink supply port 14 in the horizontal direction. Particularly, even if the ink tank 10 is of thin and flat type, the provision of the groove 17 makes it possible to fill ink efficiently on the entire bottom surface of the first ink holding member 50 including the portion away from in the ink supply port 14 in the horizontal direction in which it has been difficult to fill ink in accordance with the conventional art.

Figure 5D:
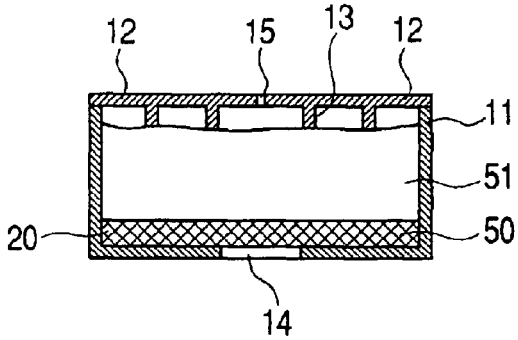

After that, with ink being filled continuously, the ink-filled area 20 expands toward to the side were the atmosphere communication port 15 is provided. At this juncture, due to the difference between the holding powers of the first ink holding member 50 and the second ink holding member 51, ink is at first filled in the first ink holding member 50 priorly. With this, and the filling of ink in the wide area on the bottom face of the first ink holding member 50 as described above, the ink-filled area 20 is once expanded on the entire area of the first ink holding member 50 as shown in FIG. 5D in the ink filling process, and it is made possible to keep the condition in which almost no ink to be expanded on the second ink holding member 51 side in accordance with the structure of the present embodiment.

Figure 5E:
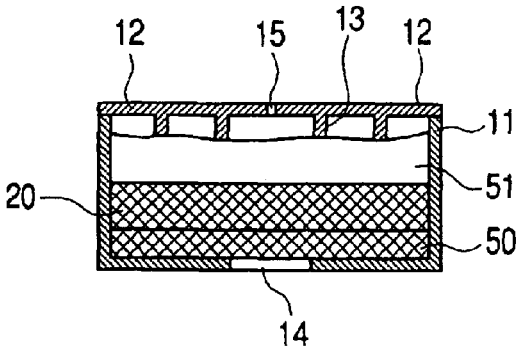
Figure 5F:
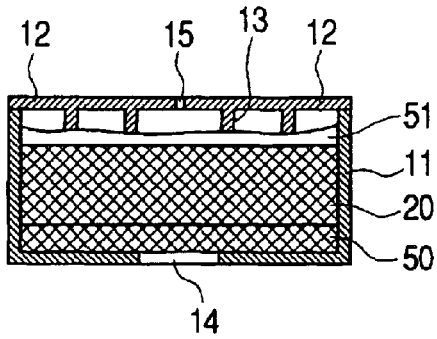

Subsequently, then, when ink is filled, ink begins to be filled in the second ink holding member 51 through the first ink holding member 50. At this juncture, ink is once filled entirely in the first holding member 50, and then, filled into the second holding member 51 almost uniformly from the entire abutting faces of the first ink holding member 50 and second ink holding member 51. As a result, the ink-filled area 20 expands to the atmosphere communication port 15 side, while keeping the ink interface almost horizontally as shown in FIGS. 5E and 5F.

Then, after the completion of the ink injection in a predetermined amount, the injection valve is closed, and then, the decompression valve, which has closed the atmosphere communication port 15, is released to complete the ink injection.

In this manner, the present embodiment makes it possible to fill ink in the first ink holding member 50 and the second ink holding member 51 efficiently and almost uniformly on the wide area in the horizontal direction, hence enhancing the ink filling efficiency. The action of the kind can be obtained effectively particularly when the ink tank 10 is configured to be thin and flat.

In this respect, the present embodiment illustrates the invention hereof, and does not necessarily limit it. The various modifications are possible within the range thereof. For example, the width and depth of the groove 17 are not necessarily limited to the size described above. The size may be appropriately defined within a range where the grove 17 is not buried by the elastic deformation of the first ink holding member 50 that abuts against the bottom face on which the groove 17 is formed.

At this juncture, it is preferable to make the depth of the groove 17 0.5 mm or less so that no influence is exerted on the outer shape of the container 11, and the width of the groove 17 1 mm or less so as to form space assuredly. With the setting thus made, it is possible to demonstrate the effect of the present invention sufficiently. Here, after the ink injection, the ink supply port 14 is usually closed for keeping the ink tank 10 in storage or for distribution. In this status, if the air in the closed space formed for the groove 17 expands due to the environmental changes, such as temperature and atmospheric pressure at the time of distribution and pushes out the ink, which are retained in the ink holding members 50 and 51, the resultant ink leakage may take place. Therefore, it is preferable to minimize the size of the groove 17 as far as allowable. In this manner, it becomes possible to secure reliability thereof.

Figure 6A:
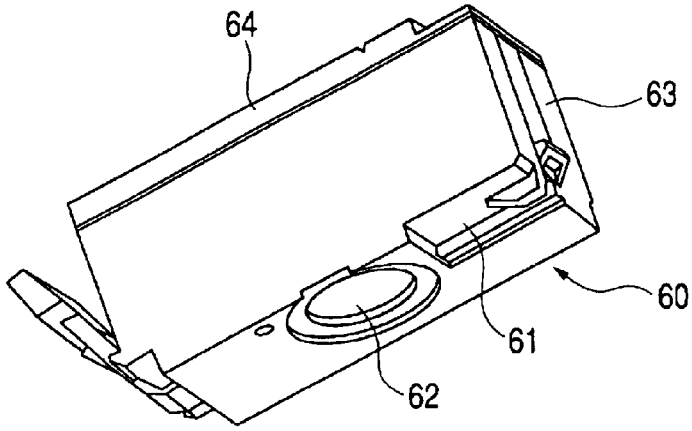
FIGS. 6A, 6B, and 6C are views that illustrate an ink tank in accordance with another embodiment of the present invention.
Figure 6B:
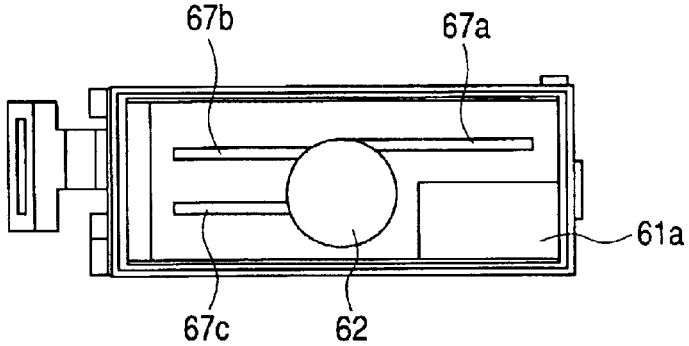
Figure 6C:
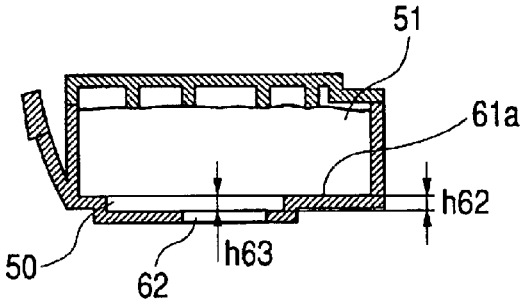

Also, the positions and number of groves 17 can be appropriately defined in accordance with the size and shape of the bottom face of the ink tank 10, and the location where the ink supply port 62 is formed, among some others. FIGS. 6A to 6C are views that illustrate one variational example of the ink tank 60 of the present embodiment, the setting of the groove 17 of which has been modified as described above. FIG. 6A is a perspective view of the ink tank 60. FIG. 6B is a plan view that shows the structure of inner face of the bottom portion of the container 63 in a state where the covering member 64, and the first and second ink holding members 50 and 51 are removed. FIG. 6C is a cross-sectional view.

For the ink tank 60, there is provided on a part of the bottom face a recessed portion 61, which is formed substantially on a half of the front side of the right-hand side in FIGS. 6A to 6C. As a result, for the inner face of the bottom portion, an extrusion 61*a* is formed corresponding to the recessed portion 61, thus pressing a complicated shape. In this case, as shown in FIG. 6B, for example, one groove 67*a* is arranged on the side of the ink supply port 62 where the extrusion 61*a* is arranged, that is, on the right-hand side, and two grooves 67*b* and 67*c* are arranged on the left-hand side. In this way, it becomes possible to make the ratio of area occupied by the grooves on the right and left sides substantially equal, and also, to make the distance and the like substantially equal between the location farthest from the groove, and the groove on the bottom face of the first ink holding member 50. Thus, when ink is injected, it is made possible to fill ink almost uniformly on the entire bottom face of the first ink holding member 50.

Also, in accordance with this structure, the height h62 of the extrusion 61*a* is set equally to the thickness h63 of the first ink holding member 50 as shown in FIG. 6C. In this way, it is made possible to form gap desirably inside the container 11. At this juncture, the first ink holding member 50 is not provided for the portion of the extrusion 61*a*, and the area thereof is made smaller than that of the second ink holding member 51. Even in this case, too, if only the area of the first ink holding member 50 is more than the area of the second ink holding member 51 to a certain extent or more, it is possible to keep the function of the present invention, that is, to substantially equalize the filling and consumption of ink within the horizontal surface. Therefore, it is preferable to keep the area of the first ink holding member 50 to be more than 75% of the area of the second ink holding member 51.

Also, in accordance with the present embodiment, the example of the decompressed injection method is shown, that is to inject ink after the inside of the ink tank 10 is decompressed. However, the ink injection method is not necessarily limited thereto. It may be appropriately selected depending on the physical value of ink to be injected or the material of the ink holding members 50 and 51 to be used. For example, in a case where the contact angle to the ink holding members 50 and 51 is large with respect to ink wetness, the viscosity of ink is high, or the like where ink is not easily permeated into the ink holding members 50 and 51, it is preferable to select the decompressed injection method particularly when the contact angle to the ink holding members 50 and 51 is 90° or more with respect to ink wetness. On the other hand, if the contact angle to the ink holding members 50 and 51 is smaller with respect to ink wetness or ink can be permeated into the ink holding members 50 and 51 easily, it is preferable to select the pressurized injection method, particularly in a case where the contact angle to the ink holding members 50 and 51 is less than 90° with respect to ink wetness, and the permeability of ink is so high that when ink drops to the ink holding members 50 and 51, it is permeated without forming ink droplets.

Also, the present embodiment exemplifies an arrangement in which the groove 17 is given specific gaps between the wall faces 11*a* and 11*b*. This arrangement is preferable because the ink, which is filled in the groove 17, is not allowed to travel and flow along the wall faces 11*a* and 11*b*, thus demonstrating the maximum effect of the present invention. Nevertheless, in a case where the ink, which has high permeability is injected into the ink holding members 50 and 51 as described above, it may be possible to arrange the structure so that the groove formed on the bottom face of the ink tank is allowed to expand up to the wall faces of the ink tank.

Figure 7:
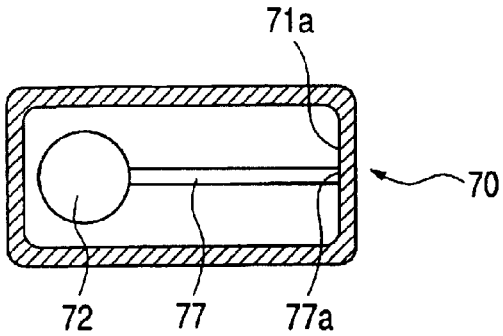
FIG. 7 is a cross-sectional view that shows the structure of the inner face of the bottom portion of an ink tank in accordance with still another embodiment of the present invention.

FIG. 7 is a cross-sectional view that shows the structure of the inner face of the bottom portion of an ink tank 70, which is another variational example of the present embodiment. The size of this ink tank 70 is 12 mm wide and 25 mm long. The ink supply port 72 has a diameter of 6 mm, which is arranged in a position offset to the left side in FIG. 7. This ink tank 70 uses ink of high permeability with respect to the ink holding members 50 and 51 as described above, and also, the width of the ink tank 70 is narrow. As a result, it should be suffice if only one groove 77 is formed as shown in FIG. 7. Then, the tip 77*a* of the groove 77 formed on the bottom face expands until it is connected with the wall face 11*a*. For the ink tank 70, the pressurized injection can be selected as the ink injection method.

Next, in conjunction with FIG. 10, and FIGS. 11A and 11B, the description will be made of the variational example of an ink tank provided with the liquid holding members of the present invention. In this respect, the same reference marks are applied to the same portions as those of the previous embodiments. Then, the description thereof will be omitted.

Figure 10:
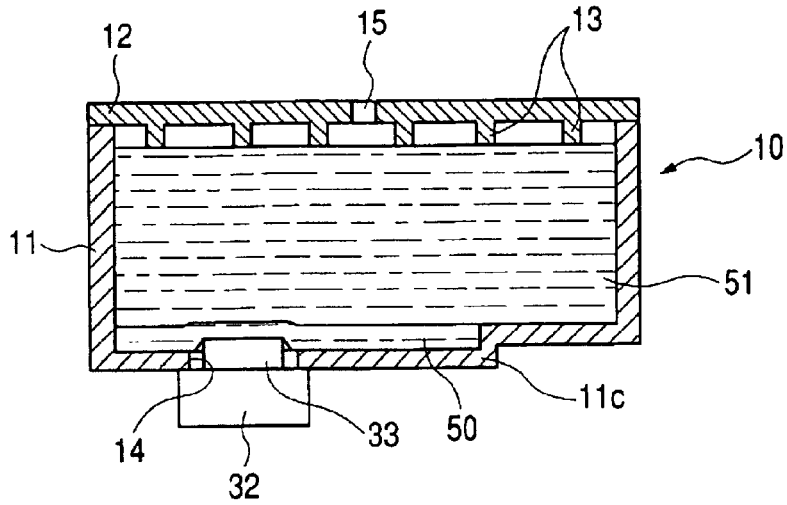
FIG. 10 is a cross-sectional view that shows the variational example of the status of conjugation between the ink tank and ink jet head in accordance with the present invention.

As shown in FIG. 10, in accordance with the present embodiment, it is arranged to form the portion of the container 11 of the ink tank 10, against which the ink receiving tube 33 abuts, to be extruded, and then, to arrange the first ink holding member 50 for this extruded portion 11*c*.

For this variational example, too, the ink holding members 50 and 51 are the aggregate of laminated fibers formed by polyolefin thermoplastic resin as in the cases of the embodiments described earlier. The first ink holding member 50 is formed by fibers the fineness of which is 6.7 dtex (diameter: approximately 54 $\mu$m), and the concentration is approximately 0.05 g/cm$^3$ after compression. The second ink holding member 51 is formed by fibers the fineness of which is 2.2 dtex (diameter: approximately 18 $\mu$m), and the concentration is approximately 0.15 g/cm$^3$ after compression. The fibrous directions of the first ink holding member 50 and the second ink holding member 51 arranged in the container 11, that is, the longitudinal direction (main axial direction) of the majority of fibers that form these fibrous bodies, are all essentially perpendicular to the abutting direction on the ink receiving tube 33, and also, the laminating direction of the webs of the fibrous bodies is substantially in parallel with the abutting direction on the ink receiving tube 33.

The plane configuration of the first ink holding member 50, which is perpendicular to the abutting direction to the ink receiving tube 33, is rectangular of 10 mm×23 mm, and the thickness thereof is 1.5 mm. The plane configuration of the second ink holding member is rectangular of 14 mm×23 mm, and the thickness thereof is 12.5 mm.

Also, it is arranged to form the container 11 and the covering member 12 of the ink tank 10 by the same polyolefin resin material as the first ink holding member 50 and the second ink holding member 51.

For the present embodiment, the ink tank 10 is formed in a complicated shape such as to arrange the extrusion 11*c* on the ink supply port 14 side due to the structural reasons of the recording apparatus main body. In this shape, it becomes possible to form a large second ink holding member 51 in a simple rectangular parallelepiped as shown in FIG. 10 with the configuration of the first ink holding member 50, which is made essentially the same as the inner side configuration of the extrusion 11*c* in the housing 11 by making the thickness of the first ink holding member 50 in the direction in which the ink receiving tube 33 abuts against it to be substantially the same dimension as the depth of inner side of the extrusion 11*c* of the housing 11. In this manner, it is made possible to attempt the enhancement of productivity.

Figure 11A:
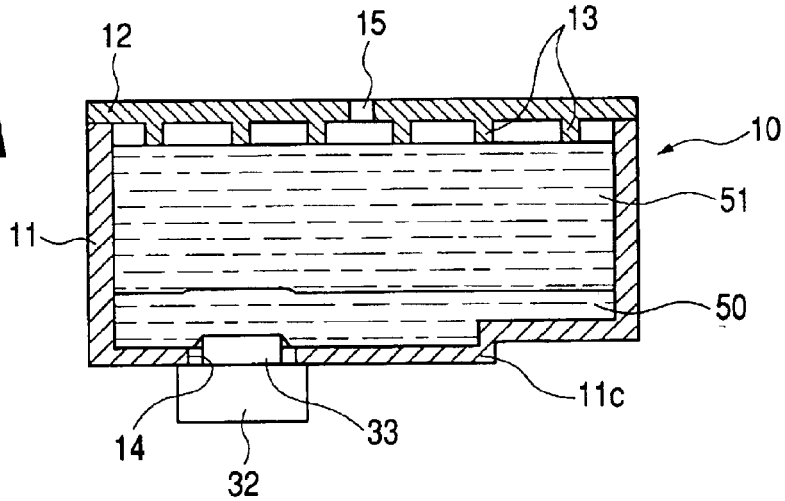
FIG. 11A is a cross-sectional view that shows the variational example of the ink tank and ink jet head of the present invention.

FIG. 11A is a view that shows the structure as a still another variational example of the present embodiment in which a first ink holding member 50 in a hooked form, and a second ink holding member 51 simply formed in a rectangular parallelepiped are mounted in a housing 11 having the same shape as shown in FIG. 10. With the structure thus arranged, the upper face of the first ink holding member 50 is essentially the same shape as the bottom face of the second ink holding member 51. As a result, it becomes possible to use ink 52 completely without any remainders in the second ink holding member 51 even if the ink supply is conducted at high speed.

Figure 11B:
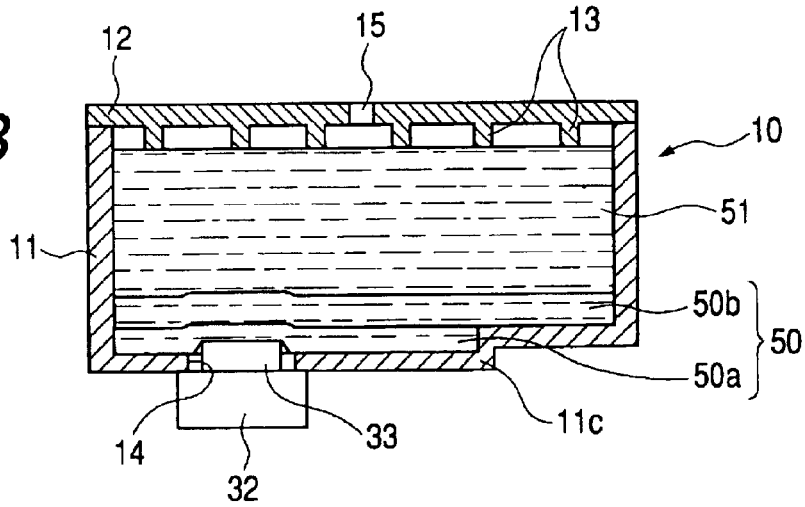
FIG. 11B is a sectional view that shows another variational example thereof.

Further, FIG. 11B is a view that shows still another variational example of the present embodiment having the structure in which the first ink holding member 50 shown in FIG. 11A is separated into tow portions, that is, the lower side portion 50*a* position on the ink supply port 14 side, and the upper side portion 50*b* sandwiched between the lower side portion 50*a* and the second ink holding member 51. In accordance with this structure, the relations of the ink holding power C1 of the lower side portion 50*a* of the ink holding member, the ink holding power C2 of the upper side portion 50*b*, and the ink howling power C3 of the second ink holding member 51 are defined to be C1>C2>C3. Then, in the same manner as the structure shown in FIG. 10, the structure thus arranged makes it possible to simplify the shapes of each ink holding member (the lower side portion 50*a*, the upper side portion 50*b*, and the second ink holding member 51), while enabling ink 52 in the second ink holding member 51 to be used completely without any remainders therein as in the case of the structure shown in FIG. 11A.

Here, as described above, the shape of the ink tank 10 is structured such as to provide the L-letter configuration having extrusion on the ink supply port 14 side. However the shape of the ink tank 10 is not necessarily limited to the shape thus described above. For example, it may be possible to configure the ink tank 10 so that the central portion thereof is extruded.

Also, in accordance with the embodiment described above, polyolefin fibrous bodies form the ink holding members 50 and 51. However, the structure of the ink holding members 50 and 51 is not necessarily limited to being formed by fibrous bodies, and the material thereof is not necessarily limited to polyolefin resin. The concentrations, fibrous diameters, fibrous directions, and the like of the ink holding members 50 and 51 are not necessarily limited to the aforesaid two embodiments, either. It may be possible to appropriately define the thickness of the ink holding members 50 and 51 in the abutting direction on the ink receiving tube 33, not necessarily limited to the aforesaid two embodiments, either, in consideration of the kinds of ink to be used, the structures of the ink holding members 50 and 51, the flow rate of ink, and others. However, in order to enable the present invention to demonstrate the effects thereof fully, it is desirable to make the ratio 1:5 or more between the thickness of the first ink holding member 50 in the direction in which the ink receiving tube 33 abuts against it, and the maximum inner diameter of the dimension in the direction perpendicular thereto. In this respect, the liquid, which is retained in the liquid container of the present invention, is not necessarily limited to ink. Then, when ink is retained, the color and kind thereof are not necessarily limited, either, to black, cyan, yellow, magenta, or others.

What is claimed is:

1. An ink tank comprising:

ink holding means capable of impregnating and retaining ink; and a housing for containing said ink holding means, said housing being provided with an ink supply port for supplying ink impregnated in said ink holding means to the outside and an air inducing port for inducing an atmospheric air into said housing, wherein said ink holding means comprises a first ink holding member arranged on the inner face of said housing where said ink supply port is open, and a second ink holding member held closely to said first ink holding member, having smaller ink holding power than that of said first ink holding member, said first ink holding member is substantially the same shape as the shape of the inner face of said housing where said ink supply port is open, and substantially covers the said inner face entirely, and grooves communicated with said ink supply port on the inner face of said housing where said ink supply port is open.

2. An ink tank according to claim 1, wherein said grooves provided on the inner face of said housing where said ink supply port is open are arranged with gaps from inner faces of walls intersecting with the inner face of said housing where said ink supply port is open.

3. An ink tank according to claim 1, wherein said first ink holding member is sheet-like.

4. An ink tank according to claim 1, wherein said first ink holding member abuts against an external member to be inserted through said ink supply port when supplying ink to outside so that said first ink holding member is partially compressed.

5. An ink tank comprising:

a housing for containing ink holding means capable of impregnating and retaining ink;

an ink supply port provided in said housing for supplying ink in said housing to the outside, and an atmosphere communication port provided for said housing for induing the atmospheric air into said housing, and said ink tank being attachable to and detachable from an external member and ink being supplied to said external member in a state that said ink holding means is in contact with said external member, wherein said ink holding means comprises a sheet-like first ink holding member capable of being in contact with the external member, and a second ink holding member held closely with said first ink holding member for supplying ink to said first ink holding member, and the ink holding power of said first ink holding member is larger than that of said second ink holding member, and wherein said first ink holding member is substantially held in a form following the shape of inner face of said housing on a portion where said ink supply port is provided.

6. An ink tank according to claim 5, wherein said first and second ink holding members are kept to be deformed by the ink supply tube provided in a holder in a state that said ink tank is mounted on the holder.

7. An ink tank according to claim 5, wherein said first ink holding member comprises a laminated body of fibers, and a laminated direction of said laminated body is substantially the same direction as the abutting direction to the external member.

8. An ink tank according to claim 7, wherein a main axial direction of the majority of the fibers forming said laminated body follows substantially a longitudinal direction of the plane of said housing where said ink supply port is provided.

* * * * *

UNITED STATES PATENT AND TRADEMARK OFFICE

CERTIFICATE OF CORRECTION

PATENT NO. : 6,942,326 B2
DATED : September 13, 2005
INVENTOR(S) : Hiroki Hayashi et al.

It is certified that error appears in the above-identified patent and that said Letters Patent is hereby corrected as shown below:

Column 2,
Line 19, “larger” should read -- large --.

Column 3,
Line 29, “form” should read -- from --.

Column 5,
Line 34, “in” should read -- ink --.

Column 11,
Line 34, “grove” should read -- groove --; and
Line 55, “groves” should read -- grooves --.

Column 13,
Line 13, “be” should be deleted.

Column 14,
Line 22, “tow” should read -- two --; and
Line 30, “howling” should read -- holding --.

Column 15,
Line 25, “the” should be deleted.

Column 16,
Line 8, “induing” should read -- inducing --.

Signed and Sealed this

Fourteenth Day of February, 2006

JON W. DUDAS
*Director of the United States Patent and Trademark Office*